US006503612B1

(12) United States Patent
Copeland

(10) Patent No.: US 6,503,612 B1
(45) Date of Patent: Jan. 7, 2003

(54) HAND-HELD CONFORMABLE SANDING BLOCK

(75) Inventor: Shawn Copeland, Gig Harbor, WA (US)

(73) Assignee: Trade Associates, Inc., Auburn, WA (US)

( * ) Notice: Subject to any disclaimer, the term of this patent is extended or adjusted under 35 U.S.C. 154(b) by 0 days.

(21) Appl. No.: 09/594,885

(22) Filed: Jun. 14, 2000

(51) Int. Cl.[7] ..... B29D 22/00; B32B 00/00; B32B 5/16; B24D 11/00; B24D 1/00

(52) U.S. Cl. ..... 428/220; 428/516; 428/35.7; 428/323; 51/293; 51/295

(58) Field of Search ..... 428/220, 516, 428/35.7, 323; 51/293, 295

(56) References Cited

U.S. PATENT DOCUMENTS 4,202,139 A * 5/1980 Hong et al. ..... 51/393
4,966,609 A * 10/1990 Callinan et al. ..... 51/295
6,270,867 B1 * 8/2001 Eckstein et al. ..... 428/35.7
6,299,985 B1 * 10/2001 Zhang et al. ..... 428/516

* cited by examiner

*Primary Examiner*—Cynthia H. Kelly
*Assistant Examiner*—L. Ferguson
(74) *Attorney, Agent, or Firm*—Seed Intellectual Property Law Group PLLC

(57) ABSTRACT

Sanding blocks that are readily conformable to curved or flat surfaces are disclosed herein. In one embodiment, a hand-held sanding block is disclosed that is an elastomeric sanding block conformable to curved or flat surfaces, wherein the elastomeric sanding block has a Shore A hardness ranging from about 45 to about 90, and wherein the elastomeric sanding block is made from a polymeric composition formulated from a plurality ingredient that includes an admixture of an ethylene-vinyl acetate copolymer and a metallocene catalyzed ethylene-α-olefin copolymer, and a blowing agent. Also disclosed are methods for manufacturing sanding blocks. Some of the more significant features associated with the inventive sanding blocks disclosed herein include: (1) sized to perfectly use the entire sanding surface area of a standard sheet of sandpaper due to an optimized outer perimeter length, which length allows such standard sheet of sandpaper to be more effectively wrapped thereabout; and (2) solves shortcomings associated with cumbersome practice of wrapping sandpaper about paint sticks.

31 Claims, 3 Drawing Sheets

HAND-HELD CONFORMABLE SANDING BLOCK

TECHNICAL FIELD

The present invention relates to sanding blocks, and more specifically, to hand-held sanding blocks that are readily conformable to curved or flat surfaces.

BACKGROUND OF THE INVENTION

In the market place today, there are a wide variety of hand-held sanding devices useful for smoothing and polishing a rough or irregular surface. In this regard, a particularly common type of hand-held sanding device is a wood block having a piece of sandpaper wrapped about its exterior. Another common type of hand-held sanding device is a shaped block made of rubber or other resilient material, and which secures a piece of sandpaper along its bottom surface by means of holding clamps or sharp projections. Although both of these common hand-held sanding devices work well for flat surfaces, they do not work particularly well for curved surfaces. In addition, such sanding devices also generally require the cutting and trimming of standard size sheets of sandpaper to an appropriate size.

In short, the above-mentioned common sanding blocks have relatively large, flat sandpaper support surfaces which do not satisfactorily conform to the shape of curved surfaces. Thus, the use of such common sanding blocks on curved surfaces often results in uneven sanding; mainly because such blocks are not bendable to the curvature of the surface being sanded, and because excessive pressure is often applied to some portions of the surface being sanded. Moreover, the application of excessive pressure may result in over sanding and rapid deterioration of the sandpaper, which, in turn, may damage the underlying surface. Concomitantly, common sanding blocks typically under utilize standard size sheets of sandpaper (dimensions of 8.5"×11") in that such sheets must be cut and/or trimmed to fit the sanding block's support surface; such cutting often results in usable scrap material.

A common situation where curved and flat surfaces are in need of sanding involves the body repair of automobiles prior to repainting. Although the sanding of automobiles has been practiced for a long time, the problems associated therewith are numerous. For example, some automobile body parts are relatively smooth, but have sloping curves, and are thus difficult to sand evenly (e.g., conventional sanding devices often result in a "rippling" effect along the surface being sanded). Other body parts are flat, but nevertheless need to be sanded without scratching the surrounding areas (such as the painted surfaces between tail lights and the like). Because of these problems, automobiles are often finish sanded by hand (i.e., sandpaper supported by the hand and digits of an individual laborer). For example, it is currently a common practice for laborers in automobile repair shops to use two "paint sticks"stacked together as a support structure for a piece of sandpaper. Such paint sticks are cumbersome to use, have a tendency to form a rippling effect along the surface being sanded, and under utilizes the full sanding surface available with a standard sheet of sandpaper.

Accordingly, there is a need in the art for hand-held sanding blocks that are readily conformable to curved or flat surfaces, and which better utilizes standard sheets of sandpaper. The present invention fulfills these needs and provides for further related advantages.

SUMMARY OF THE INVENTION

In brief, the present invention is directed to hand-held sanding blocks that are readily conformable to curved or flat surfaces. In one embodiment, the hand-held sanding block is an elastomeric sanding block conformable to curved or flat surfaces, wherein the elastomeric sanding block has a Shore A hardness ranging from about 45 to about 90, and wherein the elastomeric sanding block is made from a polymeric composition formulated from a plurality ingredients. The plurality of ingredients includes, among other things, an admixture of an ethylene-vinyl acetate copolymer and a metallocene catalyzed ethylene-α-olefin copolymer (wherein the admixture is in an amount that ranges from about 50 to about 100 percent of the composition by weight), and a blowing agent (e.g., an azodicarbonamide compound). In other embodiments, the plurality of ingredients further includes one or more of a filler (e.g. calcium carbonate), a processing additive (e.g., stearic acid, zinc oxide, titanium oxide, and an organic peroxide), and an extending oil.

The sanding blocks of the present invention may have cubic rectangular dimensions, preferably such cubic rectangular dimensions have an outer perimeter of about 334 mm (e.g., rectangular dimensions in one preferred embodiment are about 279 mm (L) by about 35 mm (W) by about 20 mm (T)). Further, the sanding blocks of the present invention generally have densities of about 10 to about 30 pounds per cubic foot (PCF), and preferably densities of about 20 pounds per cubic foot (PCF). Further still, the sanding blocks of the present invention have Shore A hardness ranging from about 50 to about 85, and preferable ranging from about 60 to about 75, and even more preferable from about 65 to about 70.

The present invention is also directed to a method for manufacturing an elastomeric sanding block conformable to curved or flat surfaces. In general, the method comprises the steps of: compounding a polymeric composition formulated from a plurality ingredients that include at least an admixture of an ethylene-vinyl acetate copolymer and a metallocene catalyzed ethylene-α-olefin copolymer, wherein the admixture is in an amount that ranges from about 50 to about 100 percent of the composition by weight; combining the polymeric composition with a blowing agent and an organic peroxide cross-linking agent under heat to yield a feedstock; calendering the feedstock to yield a material sheet; thermoforming the material sheet in a mold to yield a foamed material sheet; and cutting the foamed material sheet to yield the elastomeric sanding block.

DETAILED DESCRIPTION OF THE INVENTION

Figure 1:
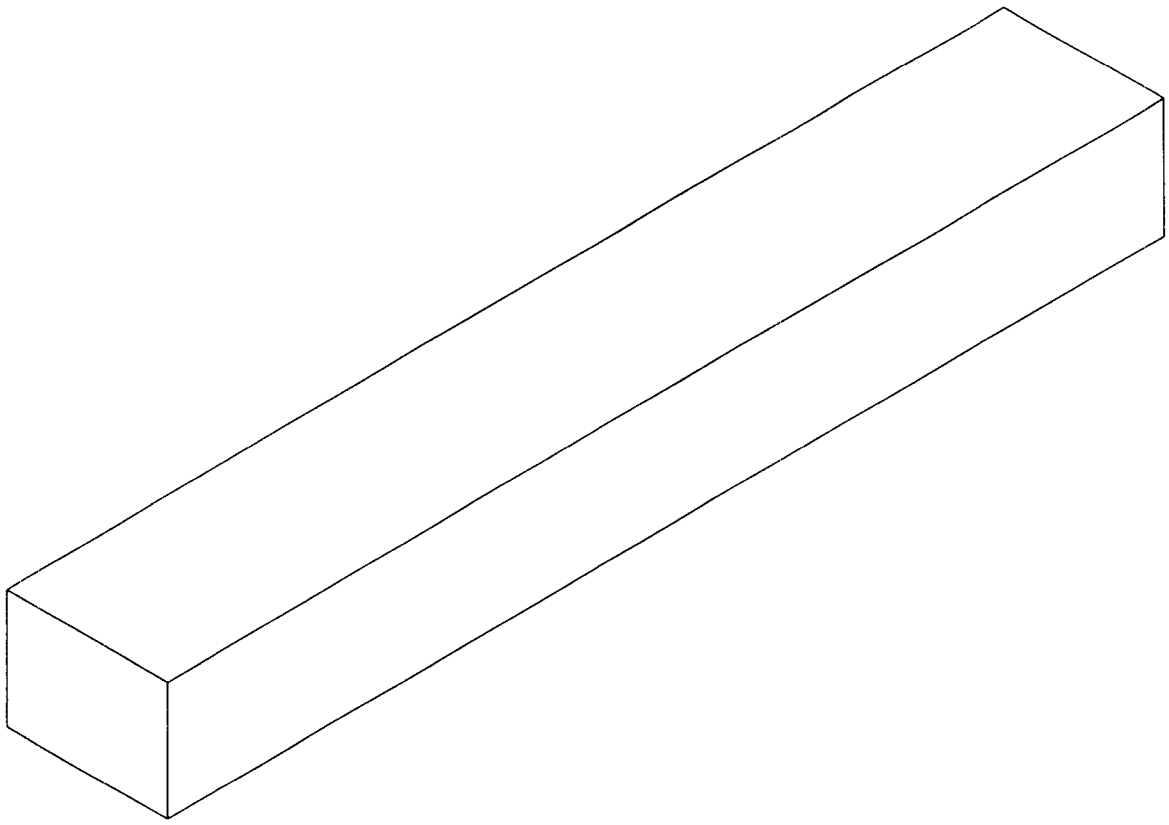
FIG. 1 is an isometric view of an exemplary sanding block in []accordance with the present invention.

As noted above, the present invention relates to sanding blocks, and more specifically, to hand-held sanding blocks that are readily conformable to curved or flat surfaces. Some of the more significant features associated with the inventive sanding blocks disclosed herein include: (1) sized to perfectly use the entire sanding surface area of a standard sheet of sandpaper due to an optimized outer perimeter length, which length allows such standard sheet of sandpaper to be more effectively wrapped thereabout; and (2) solves shortcomings associated with cumbersome practice of wrapping sandpaper about paint sticks. Although many specific details of certain embodiments of the invention are set forth in the following detailed description and accompanying Figures, those skilled in the art will recognize that the present invention may have additional embodiments, or that the invention may be practiced without several of the details described herein.

In one embodiment, the present invention is directed to an elastomeric sanding block conformable to curved or flat surfaces, wherein the elastomeric sanding block has a Shore A hardness (ASTM D2240) ranging from about 45 to about 90. In this embodiment, the elastomeric sanding block is made from a polymeric composition formulated from a plurality ingredients that includes: an admixture of an ethylene-vinyl acetate copolymer and a metallocene catalyzed ethylene-α-olefin copolymer, wherein the admixture is in an amount that ranges from about 50 to about 100 percent of the composition by weight; and a blowing agent. In further embodiments, the plurality of ingredients that are used to make the elastomeric sanding block further includes one or more of a filler, a processing additive, and an extending oil.

For purposes of clarity, a brief review of polymer nomenclature is provided to aid in the understanding of the present invention. In general, a polymer is a macromolecule (i.e., a long chain molecular chain) synthetically derived from the polymerization of monomer units or which exists naturally as a macromolecule (but which is still derived from the polymerization of monomer units). The links of the molecular chain are the monomer units. For example, polyethylene is a polymer derived from the monomer propylene ($CH_2{=}CH_2$). More specifically, polyethylene is a "homopolymer"—that is, a polymer consisting of a single repeating unit, namely, the monomer ethylene ($CH_2{=}CH_2$).

In contrast, a "copolymer" is a polymer containing two (or more) different monomer units. A copolymer may generally be synthesized in several ways. For example, a copolymer may be prepared by the copolymerization of two (or more) different monomers. Such a process yields a copolymer where the two (or more) different monomers are randomly distributed throughout the polymer chain. These copolymers are known as "random copolymers." Alternatively, copolymers may be prepared by the covalent coupling or joining of two homopolymers. For example, the covalent coupling of one homopolymer to the terminus of a second, different homopolymer provides a "block copolymer." A block copolymer containing homopolymer A and homopolymer B may be schematically represented by the following formula: $(A)_x(B)_y$ where $(A)_x$ is a homopolymer consisting of x monomers of A, $(B)_y$ is homopolymer consisting of y monomers of B, and wherein the two homopolymers are joined by a suitable covalent bond or linking spacer group. While the above formula illustrates a block copolymer having two block components (i.e., a "di-block copolymer"), block copolymers may also have three or more block components (e.g. a "tri-block copolymer" schematically represented by the formula $(A)_x(B)_y(A)_x$ or simply A-B-A, as well as a "multiblock copolymer" schematically represented by the formula $-(A\text{-}B)_n-$).

As noted above, an exemplary elastomeric sanding block in accordance with the present invention may be made from a plurality ingredients that include, among other things, an admixture of an ethylene-vinyl acetate copolymer and a metallocene catalyzed ethylene-α-olefin copolymer. As is appreciated by those skilled in the art, ethylene-vinyl acetate copolymers (also commonly referred to as "EVA") are generally available as random copolymers, whereas metallocene catalyzed ethylene-α-olefin copolymers are generally available as di-block copolymers. In general, the ethylene-vinyl acetate component is the major component; however, either the ethylene-vinyl acetate copolymer or the metallocene catalyzed ethylene-α-olefin copolymer may range up to 100% of the plurality of ingredients.

With respect to the ethylene-vinyl acetate copolymer component, it is to be understood that this copolymer refers to one or more copolymers derived from the random copolymerization of acetate and ethylene. In general, the ethylene-vinyl acetate copolymer has a vinyl acetate component ranging from 9% to 40% by weight, densities (gm/cc) generally ranging from 0.92 to 0.96, melt indexes (ASTM 1238) generally ranging from 0.3 to 43, and melting points (° C, by DSC) generally ranging from 63–100. The ethylene-vinyl acetate copolymer may be any one of a number of readily available EVA commercial grades (e.g., Elvax, Dupont Industrial Polymers, United States).

With respect to the ethylene-α-olefin copolymer component, it is to be understood that this copolymer generally comprises one or more metallocene catalyzed ethylene-α-olefin copolymers, and more preferably, metallocene catalyzed ethylene-α-olefin copolymers selected from one or more of an ethylene-butene copolymer, an ethylene-hexene copolymer, and an ethylene-octene copolymer (any one of which may also be classified as a thermoplastic elastomer). In general, the alpha-olefin component of the ethylene-α-olefin copolymer ranges from 2% to 30% by weight of the copolymer. Moreover, the metallocene catalyzed ethylene-α-olefin copolymers have densities (gm/cc) generally ranging from 0.86 to 0.95, melt indexes (ASTM 1238) generally ranging from 0.2 to 30, and melting points (° C, by DSC) generally ranging from 50–120. In one embodiment, the metallocene catalyzed ethylene-α-olefin copolymer comprises an ethylene-octene copolymer (e.g., Engage, Dupont Dow Elastomers, United States).

As is appreciated by those skilled in the art, polymers manufactured using metallocene based catalyst technology have only been commercially available since about the early 1990's. More importantly, however, is that metallocene polymerization technology now allows for the manufacturing of relatively high molecular weight copolymers of very specific tacticities (e.g., isotactic and syndiotactic polymers), as well as the polymerization of almost any monomer—beyond the traditional $C_3$ to $C_8$ olefins—in an exact manner. (Note that a metallocene, as is appreciated by those skilled in the art, is a positively charged metal ion sandwiched between two negatively charged cyclopentadienyl anions.) In addition, those skilled in the art also recognize that ethylene-α-olefin copolymers, derived from metallocene based catalyst technology, include polyolefin "plastomers" or POPs (the name given to Exxon's EXACT product line, which is manufactured with proprietary EXXPOL catalyst technology, Exxon Chemical, United States) and polyolefin "elastomers" or POEs (the name given to Dupont Dow Elastomer's ENGAGE product line, which is manufactured with its proprietary INSITE catalyst technology, Dupont Dow Elastomers LLC, United States). These new polyolefin plastomers (POPs) and elastomers (POEs) are recognized as low molecular weight, linear low density ethylene-α-olefin copolymer made possible as a result of metallocene based catalyst technology. Moreover, any one of the above-identified ethylene-α-olefin copolymers, or combinations thereof, may be used in the various compositions associated with the manufacturing of elastomeric sanding blocks in accordance with the present invention.

In order to optimize processability, the various compositions (e.g., ethylene-vinyl acetate copolymer and metallocene catalyzed ethylene-α-olefin copolymer admixtures) associated with the present invention may be compounded (albeit optionally) to a large extent with other polymers, and may also be compounded with various oils, plasticizers, fillers and extenders, as well as other specialty additives. Indeed, and as appreciated by those skilled in the polymer compounding art, any number of various processing additives may be added to enhance one or more physical characteristics and properties of the elastomeric sanding blocks disclosed herein. Exemplary of such processing additives are those identified in Gächter R., Müiller H., *The Plastics Additives Handbook,* $4^{th}$ ed., Hanser Publishers, Munich, Germany (1996) (incorporated herein by reference in its entirety).

More specifically, and in some embodiments, the various admixtures of ethylene-vinyl acetate copolymer and metallocene catalyzed ethylene-α-olefin copolymer are also compounded together with an extending oil that comprises a polyolefin oil. As used within the context of the present invention, the term "extending oil" includes carbonaceous materials added to the composition to reduce costs, or improve physical properties.

In still other embodiments, the various admixtures of ethylene-vinyl acetate copolymer and metallocene catalyzed ethylene-α-olefin copolymer are still further compounded with a processing additive. As used within the context of the present invention, the term "processing additive" includes any additive that aids in the processing, workability or otherwise enhances the performance characteristics of the materials and/or compositions to be formed into elastomeric sanding blocks in accordance with the present invention. For example, one or more other materials may be compounded with the overall composition so as to improve the composition's processability and/or performance characteristics. Thus, the term processing additives encompasses stearic acid, zinc oxide, titanium oxide, organic peroxides, or any combinations thereof. In still further embodiments, a "filler" such as calcium carbonate may also be compounded together with the one or more above-identified other ingredients.

As is further appreciated by those skilled in the art, the above-identified ingredients (which are all associated with certain preferred embodiments of the present invention) may be compounded together as in the following exemplary manner. First, desired weight percentages of ethylene-vinyl acetate copolymer and metallocene catalyzed ethylene-α-olefin copolymer, as well as desired amounts of processing additive or other specialty chemicals may be added together in an appropriately sized first mixer (e.g., 350 lb. Capacity Henschel Mixer w/cooler). This dry blend may then be mixed and allowed to reach a temperature of 80° F. prior to feeding to an appropriately sized second continuous mixer (e.g., via a Colortronic MH 60 dosing feeder to a 4 inch Farrel Continuous Mixer). The blades of the second continuous mixer may then be rotated (e.g., at 175 rpm) so as to cause the dry blend to flux into a homogeneous melt at an elevated temperature (e.g., 340° F.) at which time selected amounts of a cross-linking agent (e.g., an organic peroxide) and a blowing agent (e.g., an azodicarbonamide) are added and further mixed.

The molten composition may then be transferred and further processed through a calendering machine so as to yield a uniform sheet of a desired thickness. As is appreciated by those in the art, calendering involves extruding a mass of material between successive pairs of corotating, parallel rolls, which process yields a film or sheet. After calendering, the uniform sheet is then thermoformed in a thermoforming machine. That is, the uniform sheet may then be transferred and further processed through a thermoforming machine so as to yield a foamed material sheet. Both calendering and thermoforming are widely used processes in the thermoplastics industry.

Figure 2A:
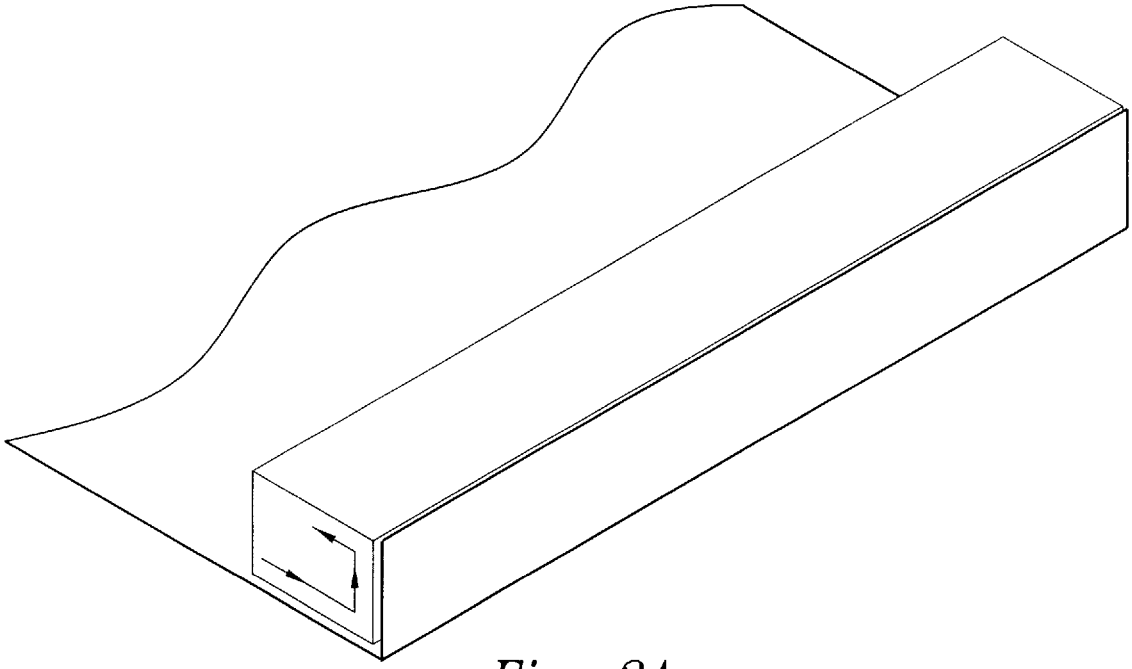
FIG. 2A–B illustrates the wrapping of a standard sheet of sandpaper about the exterior surface of an exemplary sanding block in accordance with the present invention.
Figure 2B:
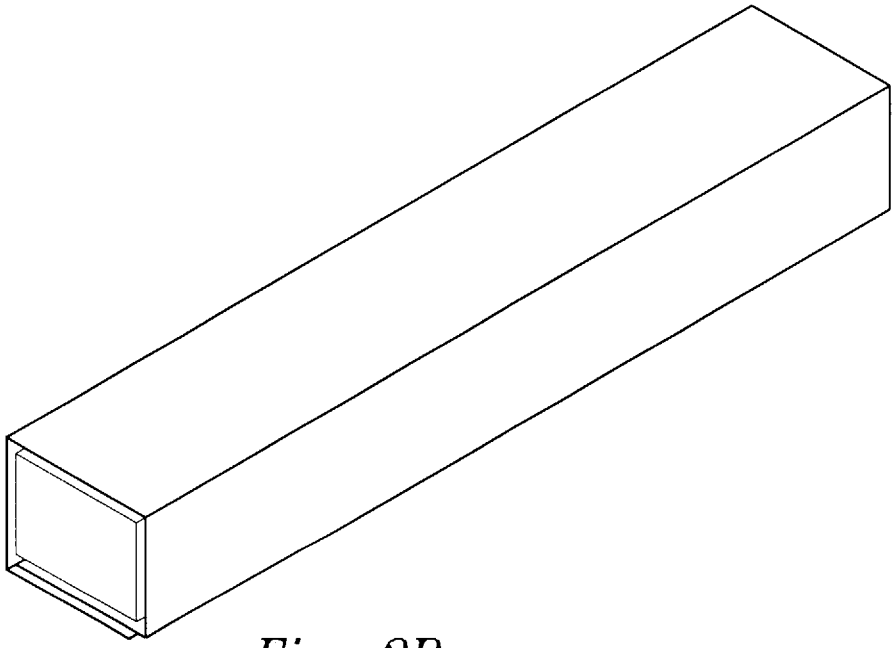

After calendering and thermoforming, the foamed material sheet is cut into numerous strips, which strips may then be used as hand-held sanding blocks conformable to curved or flat surfaces in accordance with the present invention. In one preferred embodiment and as shown in FIG. 1, the admixture of polymers and other ingredients are processed in a manner such that numerous strips have approximate dimensions of about 279 mm by about 35 mm by about 20 mm on a length by width by thickness basis (i.e., L×W×T). These dimensions are particularly advantageous in that it allows a standard size sheet of sandpaper, which has approximate dimensions of 8.5"×11", to be utilized in manner that avoids cutting and/or trimming, and allows the entire sanding surface of the sheet to be utilized. More specifically, a strip having such dimensions allows a standard size sheet of sandpaper to be tightly wrapped about its exterior as is illustrated in FIGS. 2A–B.

For purposes of illustration and not restriction, the following Example more specifically discloses various aspects of the present invention.

EXAMPLE

Figure 3:
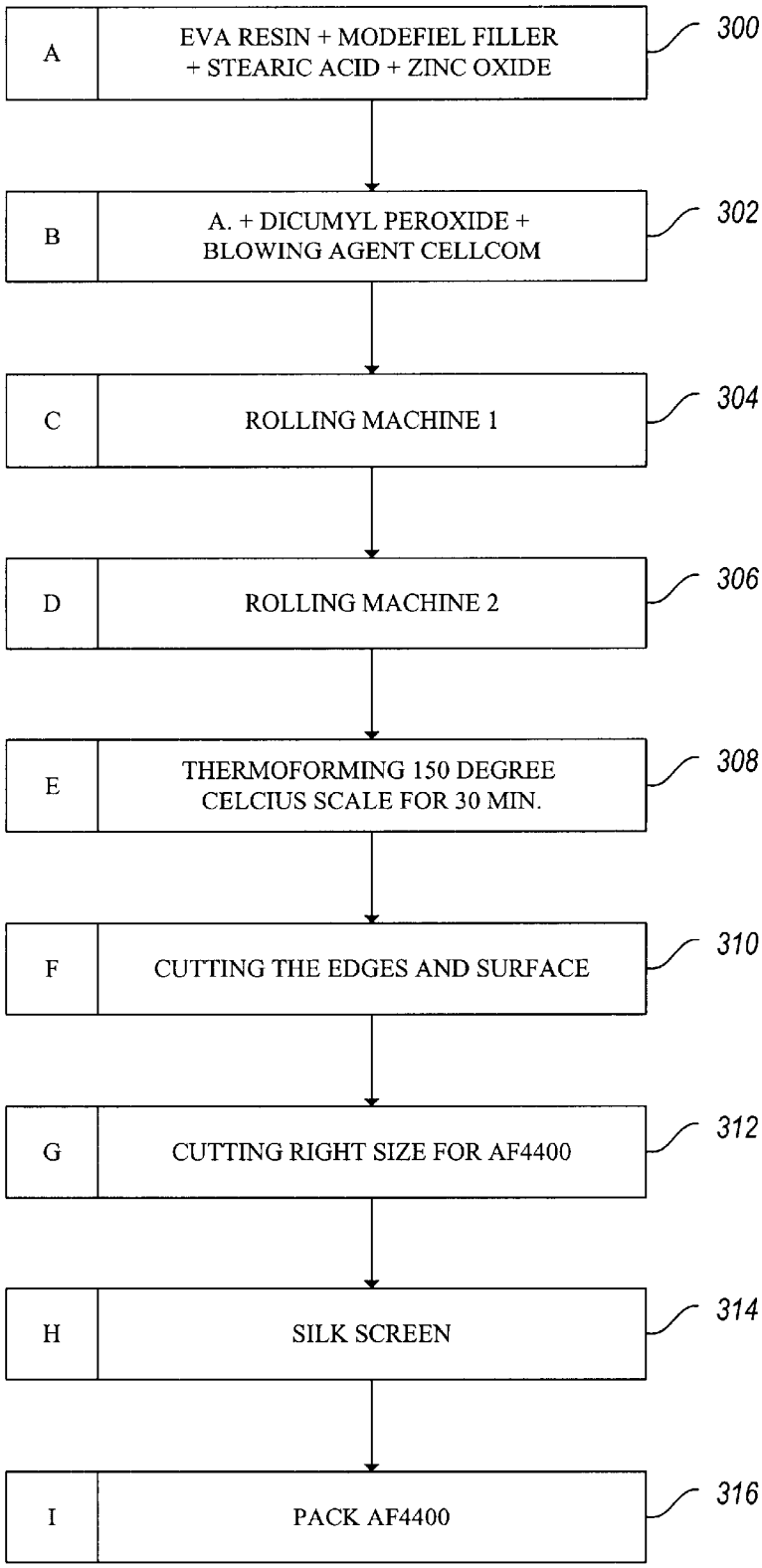
FIG. 3 is a process flow diagram depicting the process steps associated with manufacturing an exemplary sanding block in accordance with the present invention.

A hand-held elastomeric sanding block was made in accordance with the process flow diagram depicted in FIG. 3. More specifically, and in reference to FIG. 3, selected amounts of an ethylene-vinyl acetate copolymer, a calcium carbonate filler, stearic acid, and zinc oxide were admixed, stirred, and heated for approximately 10 minutes in a batch manner to yield a compounded polymeric composition (step 300). Next, selected amounts of an organic peroxide cross-linking agent and a blowing agent were admixed and stirred into the compounded polymeric composition for an additional two minutes to yield a feedstock (step 302). The feedstock was then calendered with two successive rolling machines: the first machine is under heat (step 304) and is used to make a material sheet, whereas the second machine is used to cool down the material sheet and to form it to a specified thickness (step 306). The material sheet having a specified thickness was then thermoformed in a thermoforming machine having a mold for about 30 minutes at about 150° C., thereby yielding a foamed material sheet (step 308). The foamed sheet was then cut and trimmed (step 310), and then further cut into a plurality of strip having approximate dimensions of about 279 mm (L) by about 35 mm (W) by about 20 mm (T), thereby yielding a plurality of elastomeric sanding blocks (step 312). The elastomeric sanding blocks were then silk screened (step 314), and packaged (step 316).

While the sanding block of the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. An elastomeric sanding block conformable to curved or flat surfaces, wherein the elastomeric sanding block has a Shore A hardness ranging from about 45 to about 90, and wherein the elastomeric sanding block is made from a polymeric composition formulated from a plurality of ingredients comprising:

an admixture of an ethylene-vinyl acetate copolymer and a metallocene catalyzed ethylene-α-olefin copolymer, wherein the admixture is in an amount that ranges from about 50 to about 100 percent of the composition by weight; and a blowing agent, wherein the blowing agent is an azodicarbonamide compound.

2. The elastomeric sanding block of claim 1 wherein the plurality of ingredients further comprises a filler.

3. The elastomeric sanding block of claim 2 wherein the filler is in an amount that ranges from about 5 to about 20 percent of the composition by weight.

4. The elastomeric sanding block of claim 2 wherein the filler is calcium carbonate.

5. The elastomeric sanding block of claim 1 wherein the plurality of ingredients further comprises a processing additive.

6. The elastomeric sanding block of claim 5 wherein the processing additive is one or more of stearic acid, zinc oxide, titanium oxide, and an organic peroxide.

7. The elastomeric sanding block of claim 6 wherein the processing additive is in an amount that ranges from about 0 to about 10 percent of the composition by weight.

8. The elastomeric sanding block of claim 1 wherein the metallocene catalyzed ethylene-α-olefin copolymer is an ethylene-butene copolymer, an ethylene-hexene copolymer, an ethylene-octene copolymer, or a mixture thereof.

9. The elastomeric sanding block of claim 1 wherein the metallocene catalyzed ethylene-α-olefin copolymer is an ethylene-octene copolymer.

10. The elastomeric sanding block of claim 1 having a density of about 10 to about 30 pounds per cubic foot.

11. The elastomeric sanding block of claim 1 having a density of about 20 pounds per cubic foot.

12. The elastomeric sanding block of claim 1 wherein the Shore A hardness ranges from about 50 to about 85.

13. The elastomeric sanding block of claim 1 wherein the Shore A hardness ranges from about 60 to about 75.

14. The elastomeric sanding block of claim 1 wherein the Shore A hardness ranges from about 65 to about 70.

15. The elastomeric sanding block of claim 1 wherein the Shore A hardness ranges from about 60 to about 90.

16. An elastomeric sanding block conformable to curved or flat surfaces, wherein the elastomeric sanding block has a Shore A hardness ranging from about 45 to about 90, and wherein the elastomeric sanding block is made from a polymeric composition formulated from a plurality of ingredients comprising:

an admixture of an ethylene-vinyl acetate copolymer and a metallocene catalyzed ethylene-α-olefin copolymer, wherein the admixture is in an amount that ranges from about 50 to about 100 percent of the composition by weight;

a blowing agent wherein the blowing agent is an azodicarbonamide compound;and extending oil.

17. The elastomeric sanding block of claim 16 wherein the plurality of ingredients further comprises a filler.

18. The elastomeric sanding block of claim 16 wherein the filler is in an amount that ranges from about 5 to about 20 percent of the composition by weight.

19. The elastomeric sanding block of claim 16 wherein the filler is calcium carbonate.

20. The elastomeric sanding block of claim 16 wherein the plurality of ingredients further comprises a processing additive.

21. The elastomeric sanding block of claim 20 wherein the processing additive is one or more of stearic acid, zinc oxide, titanium oxide, and an organic peroxide.

22. The elastomeric sanding block of claim 21 wherein the processing additive is in an amount that ranges from about 0 to about 10 percent of the composition by weight.

23. The elastomeric sanding block of claim 16 wherein the blowing agent is in an amount that ranges from about 0 to about 5 percent of the composition by weight.

24. The elastomeric sanding block of claim 16 wherein the metallocene catalyzed ethylene-α-olefin copolymer is an ethylene-butene copolymer, an ethylene-hexene copolymer, an ethylene-octene copolymer, or a mixture thereof.

25. The elastomeric sanding block of claim 16 wherein the metallocene catalyzed ethylene-α-olefin copolymer is an ethylene-octene copolymer.

26. The elastomeric sanding block of claim 16 having a density of about 10 to about 30 pounds per cubic foot.

27. The elastomeric sanding block of claim 16 having a density of about 20 pounds per cubic foot.

28. The elastomeric sanding block of claim 16 wherein the Shore A hardness ranges from about 50 to about 85.

29. The elastomeric sanding block of claim 16 wherein the Shore A hardness ranges from about 60 to about 75.

30. The elastomeric sanding block of claim 16 wherein the Shore A hardness-ranges from about 65 to about 70.

31. The elastomeric sanding block of claim 16 wherein the Shore A hardness ranges from about 60 to about 90.

* * * * *

UNITED STATES PATENT AND TRADEMARK OFFICE

CERTIFICATE OF CORRECTION

PATENT NO. : 6,503,612 B1
DATED : January 7, 2003
INVENTOR(S) : Shawn Copeland

It is certified that error appears in the above-identified patent and that said Letters Patent is hereby corrected as shown below:

Column 8,
Line 20, delete "claim 16" and substitute therefor -- claim 17 --.
Line 50, delete "hardness-ranges" and substitute therefor -- hardness ranges --.

Signed and Sealed this

Thirteenth Day of May, 2003

JAMES E. ROGAN
*Director of the United States Patent and Trademark Office*